US011719011B2

(12) United States Patent
Tulett et al.

(10) Patent No.: US 11,719,011 B2
(45) Date of Patent: Aug. 8, 2023

(54) MANIFOLD SYSTEM AND METHODS OF USE

(71) Applicant: Bullfrog International, LC, Herriman, UT (US)

(72) Inventors: Nathan Tulett, Pleasant Grove, UT (US); Richard Alex Eddington, South Jordan, UT (US); Eric Hales, Eagle Mountain, UT (US)

(73) Assignee: Bullfrog International, LC, Herriman, UT (US)

( * ) Notice: Subject to any disclaimer, the term of this patent is extended or adjusted under 35 U.S.C. 154(b) by 344 days.

(21) Appl. No.: 17/143,531

(22) Filed: Jan. 7, 2021

(65) Prior Publication Data

US 2021/0230894 A1 Jul. 29, 2021

Related U.S. Application Data

(60) Provisional application No. 62/964,864, filed on Jan. 23, 2020.

(51) Int. Cl.
*E04H 4/12* (2006.01)
*E04H 4/00* (2006.01)

(52) U.S. Cl.
CPC ..... *E04H 4/1245* (2013.01); *E04H 4/0037* (2013.01)

(58) Field of Classification Search
CPC ..... E04H 4/1245; E04H 4/0037
USPC ..... 4/509
See application file for complete search history.

(56) References Cited

U.S. PATENT DOCUMENTS

| | | | | |
|---|---|---|---|---|
| 4,686,439 | A | 8/1987 | Cunningham et al. | |
| 5,754,989 | A * | 5/1998 | Ludlow | A61H 33/0087 4/541.1 |
| 7,854,597 | B2 | 12/2010 | Stiles, Jr. et al. | |
| 7,874,808 | B2 | 1/2011 | Stiles | |
| 8,104,110 | B2 * | 1/2012 | Caudill | F04D 15/0066 700/282 |

(Continued)

FOREIGN PATENT DOCUMENTS

| | | |
|---|---|---|
| AU | 2012205137 A1 | 1/2013 |
| CA | 2672409 | 7/2008 |
| WO | 2009076565 A1 | 6/2009 |

OTHER PUBLICATIONS

Australian Patent Office, "First Examination Report," Australian Application No. 2020260546, dated Jun. 3, 2021.

*Primary Examiner* — Christine J Skubinna
(74) *Attorney, Agent, or Firm* — Dentons Durham Jones Pinegar; Sarah W. Matthews

(57) ABSTRACT

A spa suction bulkhead or manifold is described. The manifold may be placed behind a removable seat back of the spa or other removable structure. The manifold may have a top portion connected to a main suction line and a main pump line. The top portion may have a cylindrical wall in the center, such that the top portion is divided into a central opening (in fluid communication with the main pump line) and an outer ring portion (in fluid communication with the main suction line). The manifold may also have a cover with a central opening and a plurality of holes formed therein. A spa removable seat back containing jets may fit at its base into the central opening of the cover in fluid connection with the main pump line and allowing the outer ring portion and cover to be exposed for water intake.

17 Claims, 6 Drawing Sheets

(56) References Cited

U.S. PATENT DOCUMENTS

| | | | | |
|---|---|---|---|---|
| 8,500,413 | B2 | 8/2013 | Stiles, Jr. et al. | |
| 9,573,038 | B1 | 2/2017 | Hillyard et al. | |
| 2003/0024041 | A1* | 2/2003 | Eddington ..... | A61H 33/6063 4/541.1 |
| 2009/0151801 | A1 | 6/2009 | Gorman et al. | |
| 2011/0225720 | A1* | 9/2011 | Fleischer ..... | A61H 33/026 4/541.1 |

* cited by examiner

MANIFOLD SYSTEM AND METHODS OF USE

PRIORITY CLAIM

This application claims priority to U.S. provisional application No. 62/964,864 filed Jan. 23, 2020, which is hereby incorporated herein in its entirety.

TECHNICAL FIELD

This disclosure relates generally to a manifold or bulkhead for sucking water into the water lines and more specifically for a specific suction bulkhead assembly intended for use in Bullfrog Spas with the use of JetPak® removable seat back technology. This disclosure provides for improved use of the bulkhead while circulating water more efficiently in a spa with this new design. The features disclosed herein are numerous in nature and may be utilized in a number of different ways to provide the same or similar results.

RELATED ART

Spas typically use a manifold or bulkhead to pull water from the spa back into the pipes so that the water can be recirculated in a closed loop system. Often these suction bulkheads are located within the main body of the spa and are exposed such that a user is able to access them easily and readily within the main body. Often times these suction bulkheads are towards a base or bottom of the spa as well and typically biased toward one side of the spa.

The suction bulkhead is intended as the main suction point to pull water from within the spa to circulate that same water through the spa. The suction bulkheads are typically round and connected to the inner shell of the spa, where a user typically relaxes. The suction bulkheads then pass through the shell to the inner plumbing of a spa to connect with the pipes which are connected to the pump, or pumps, that are both pulling water in and as well as pushing water out.

Many current spas use different suction bulkheads in order to establish the proper circulation of water. Often these bulkheads are placed toward the base or bottom of the shell, essentially where a user's feet may typically be located when in the spa. The proximity and placement of current suction bulkheads in most spas can create a dangerous level of suction in the spa itself. The suction bulkheads are at a base to maximize the amount of water they can pull in; however, this can be a danger to users because of the suction level and the exposure to the main volume of the spa. Additionally, the more suction bulkheads in a general proximity the greater the danger for harm or even drowning may occur.

A bulkhead design that allows for the same level of suction and the same, or even more efficient results, while providing another degree of safety does not currently exist in the marketplace. The suction bulkhead, or manifold, described herein provides for efficient and safe suction while also providing improved results and aesthetics to the current spa design that is also user friendly.

SUMMARY

This disclosure, in at least one aspect, relates to the use of a suction bulkhead assembly, or manifold, that resides in a safer location within the spa, but also accessibly by a user.

The manifold may be positioned behind a JetPak® removable seat back and toward the base of the JetPak®. A manifold may be positioned behind each JetPak® in each sitting location to provide increased and more efficient suction because of the increased number of manifolds while not causing too much suction from any one manifold.

The plurality of manifolds may be readily accessible by removal of any of the JetPak® removable seat backs where a manifold resides. Easy removal and replacement of any one manifold is also simply afforded a user.

The manifold may include the filtering ports or holes that transverse the manifold cover to provide at least one level of filtration to prevent large particles from entering the pump(s) and comply with safety requirements. And although the manifold may be circular or cylindrical in nature a portion of the manifold cover may include a recess toward one side of the cylinder. Additionally, the manifold may include a central opening, or void, which gives the manifold a cylinder tube or even a "donut"-like appearance which allows for engagement of a JetPak® into the central opening of the manifold while leaving the manifold cover exposed. The central opening may be in communication with the main pump line that pushes water into the spa.

The manifold may be closed off from the main pump line pushing water into the spa. The manifold may further include a main suction line that connects to the cylindrical portion of the manifold that pulls the water to the main pump. The main suction line may extend in a direction that is non-parallel to or even perpendicular to the main pump line. The main suction line may extend in a downward direction or angled downward direction from the manifold when the spa is in the typical use orientation.

The main pump line and main suction line are not in fluid communication with each other, meaning water does not communicate between the two lines at the manifold, but are connected in terms of walls adjacent within the manifold body. A single piece of material may be molded or cast for the manifold with the main pump line, main suction line and the suction head, or suction body. Alternatively, the manifold may be manufactured in multiple pieces and connected through welding, glue or other means of securing the pieces together. The manifold cover may engage the manifold body through frictional fit, snap fit, threads on the manifold and the manifold cover, screws or other means to secure the cover to the body. The manifold cover may also engage the manifold via a flange in some configurations. The manifold may connect to the shell of a spa through frictional fit, snap fit, threads, etc.

There is a plurality of means and methods for configurations of the manifold and multiple variations are disclosed herein. Other aspects, as well as features and advantages of various aspects of the disclosed subject matter will become apparent to one of ordinary skill in the art form the ensuing description, the accompanying drawings and the appended claims.

DETAILED DESCRIPTION

As used herein, "JetPak® removable seat back" or "removable seat back" means a seat back, such as the portion of the spa that a user may recline their back against, that may be selectively inserted and removed from a recess in a spa shell. The removable seat back may or may not have one or more jets formed therein to force water through and into the main spa area occupied by bathers. The JetPak® removable seat back may typically be engaged within a recess of the spa shell such that water may flow behind or around the removable seat back to the recess of the spa shell.

Figure 1:
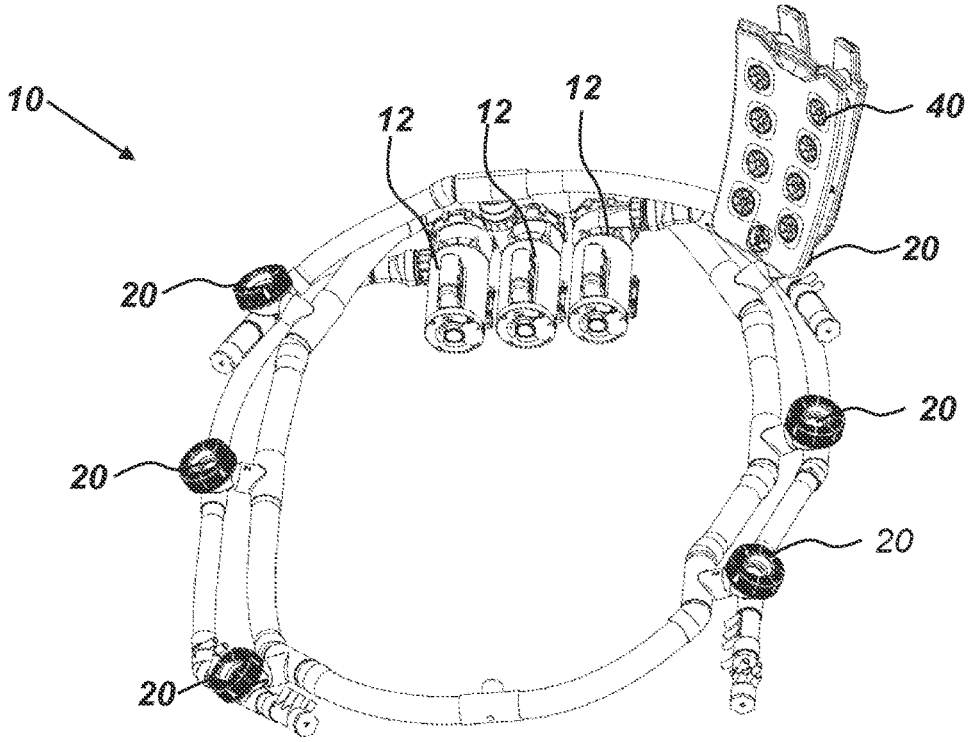
FIG. 1 is a front, top perspective view of a manifold system.
Figure 2:
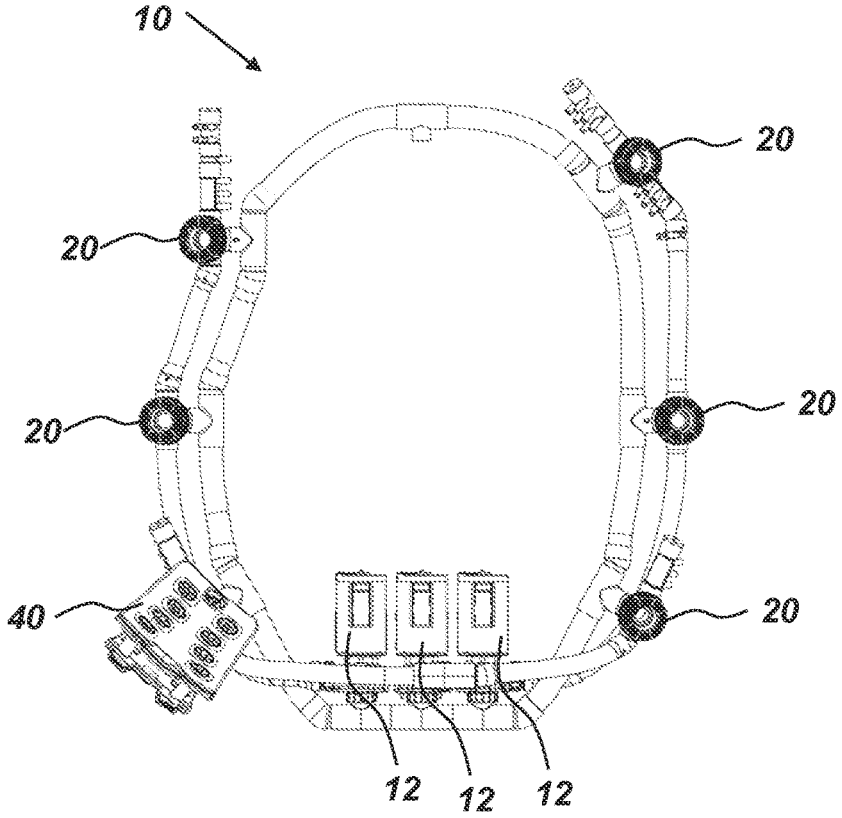
FIG. 2 is a top view of the manifold system of FIG. 1.
Figure 3:
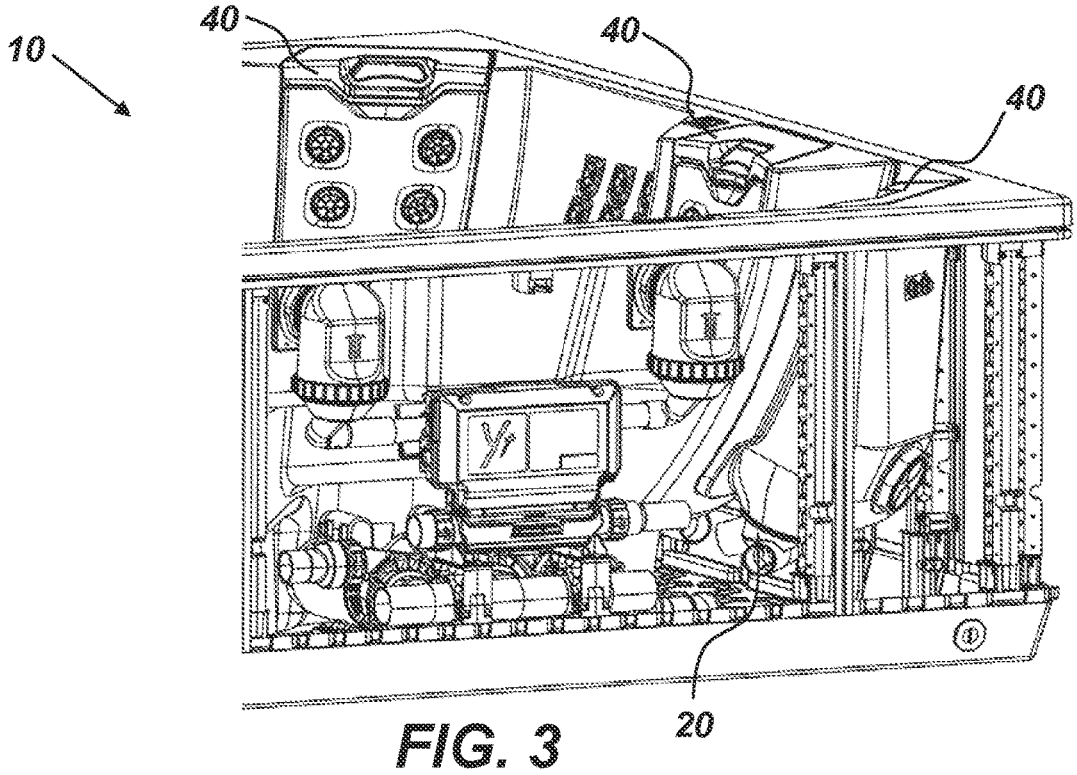
FIG. 3 is a cut-away view of a manifold system in place with a spa shell.
Figure 4:
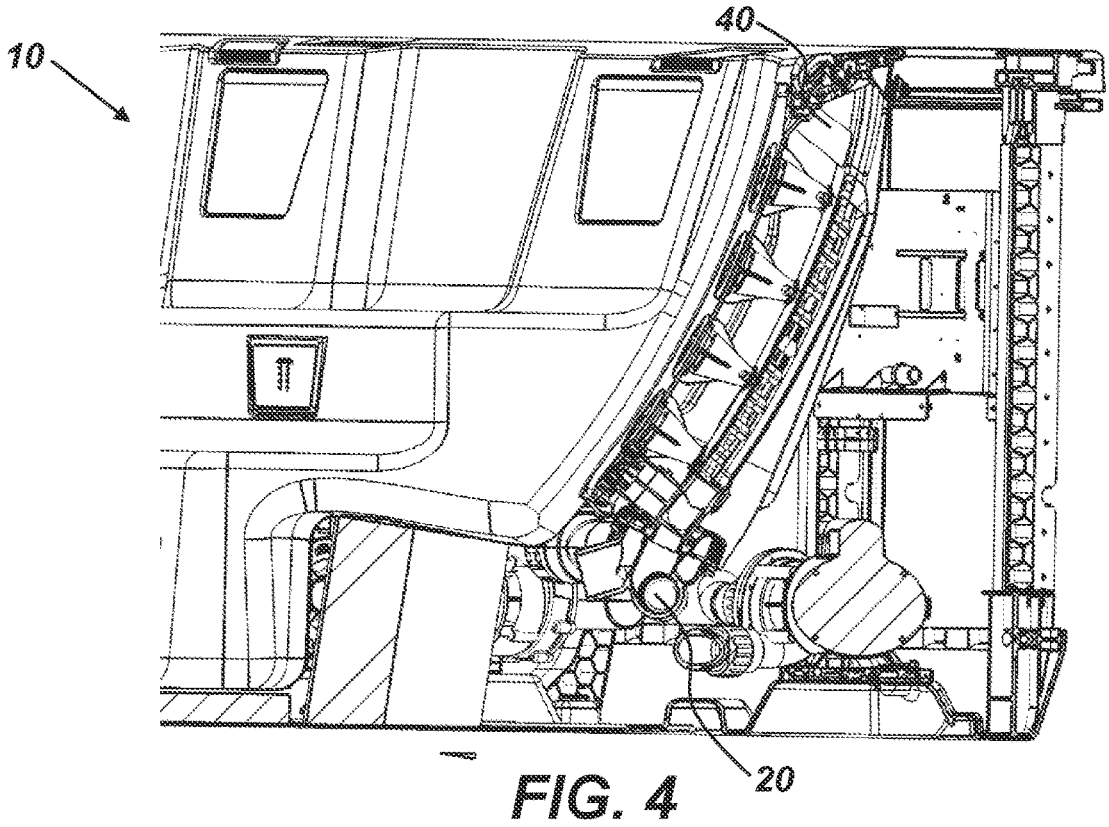
FIG. 4 is partial cross-section view of the manifold system in place with a spa shell of FIG. 3.
Figure 5:
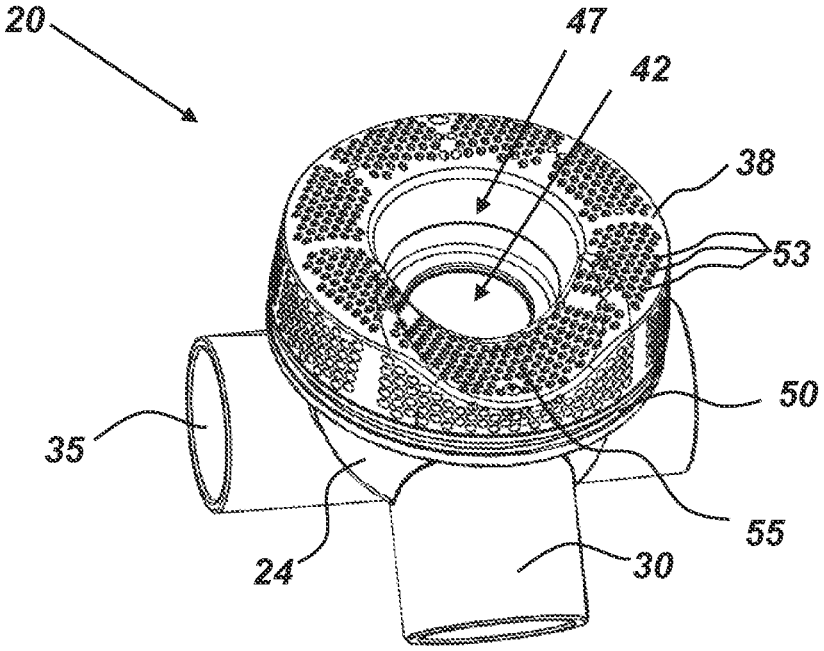
FIG. 5 is a front, top perspective view of an exemplary configuration of a manifold.
Figure 6:
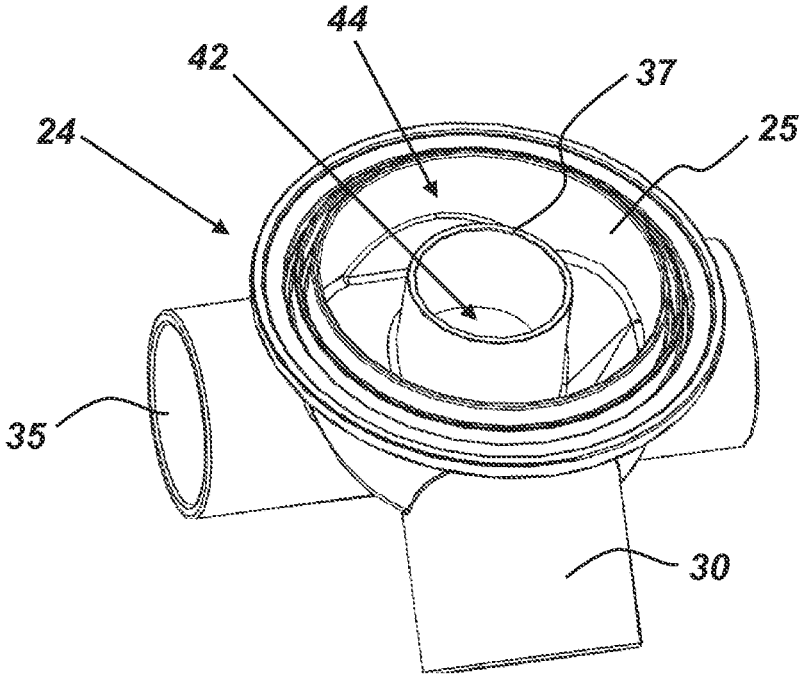
FIG. 6 is a front, top perspective view of the body portion of the manifold of FIG. 5, having the cover removed.
Figure 7:
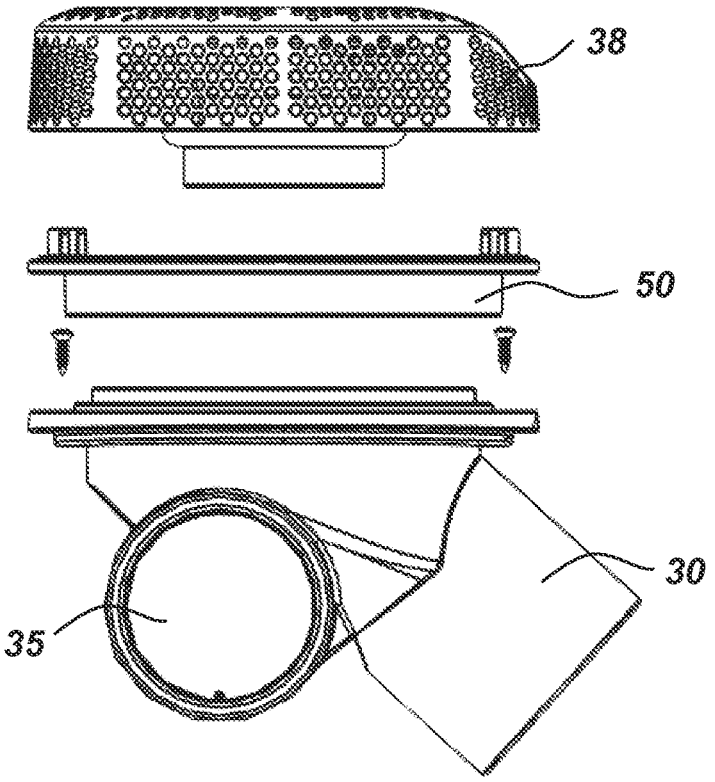
FIG. 7 is a side, exploded view of the manifold of FIG. 5.
Figure 8:
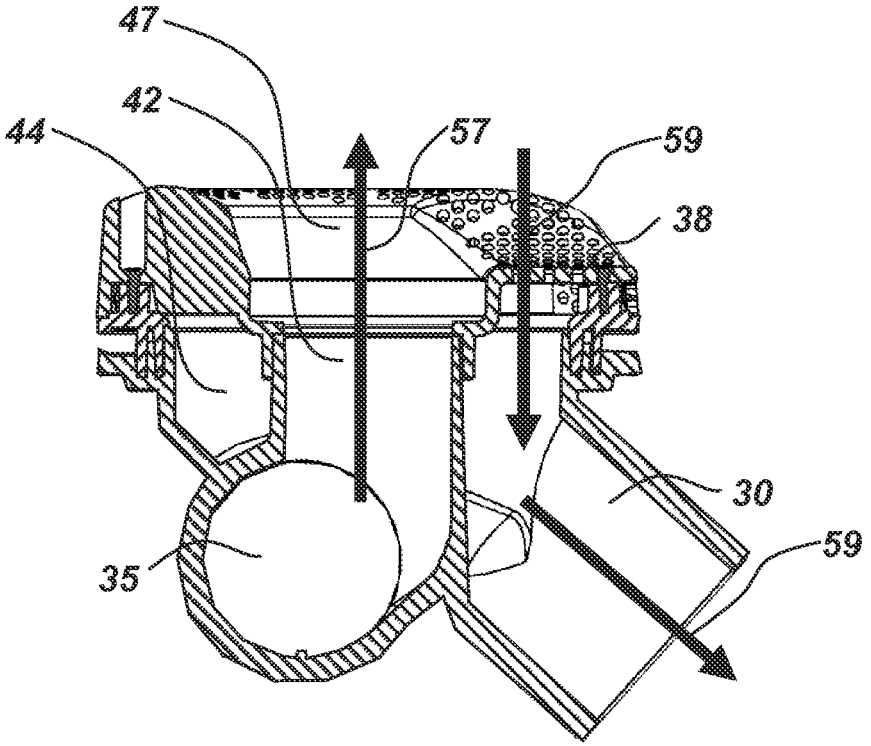
FIG. 8 is a side, cross-sectional view of the manifold of FIG. 5.

FIGS. 1-4 show a spa system 10 having a plurality of manifolds 20 as described herein. The spa shell and many other structural elements of the spa have been removed from FIGS. 1-2, as well as all but one of the JetPak® removable seat backs 40 containing water jets. As seen in FIGS. 1-2, the manifold 20 may be positioned behind the JetPak® removable seat back, and towards the base of the removable seat back 40 (FIG. 4). In this configuration, the manifold 20 is not directly positioned in the portion of the spa tub that bathers use. Because the manifold 20 is behind the JetPak® removable seat back, water from the spa tub may be taken into the manifold 20 only as it flows from the main spa tub behind, under, or otherwise around the JetPak® removable seat back 40. This placement may increase the safety of the manifold by physically separating it from the portion of the main spa tub where bathers are located. The placement may also allow users to easily access the manifold 20, for example, by removing the JetPak® removable seat back 40. In other configurations, the manifold 20 may be placed at a different location, either within the main spa tub or otherwise in fluid communication with the main spa tub. The manifold 20 may connect to the shell of a spa through frictional fit, snap fit, threads, etc.

In some configurations, a plurality of manifolds 20 may be provided, for example, one behind each JetPak® removable seat back 40. In other configurations, a single manifold 20 may be provided. Configurations with a manifold 20 positioned behind each removable seat back 40 in each sitting location, or behind two or more removable seat backs in two or more sitting locations, may provide increased suction and/or more efficient suction due to the increased number of manifolds, while also preventing too much suction from any one manifold which can cause safety issues.

Referring to FIGS. 5-8, one configuration of the manifold 20 is shown. The manifold 20 may comprise a body 24 and a cover 38. In some configurations, a flange 50 may be provided between the body 24 and cover 38 to provide a secure fit between the body 24 and cover 38. For example, the cover 38 may be secured to the flange, which may then be secured to the body 24 of the manifold. The body 24 of the manifold 20 may have a top portion 25, with a main suction line 30 and a main pump line 35 each in fluid connection with the top portion 25, but not in fluid connection with each other. The main suction line 30 may be separated from the main pump line 35, for example, by a wall 37 within the top portion 25. The wall 37 may be cylindrical and positioned within or proximal to the center of the top portion 25, so that the wall 37 divides the top portion 25 into a central opening 42 and an outer ring portion or suction head 44. The central opening 42 may be in fluid connection with the main pump line 35, while the outer ring portion 44 may be in fluid communication with the main suction line 30. In other configurations, the wall 37 may have a different shape and/or a different position. In still yet other configurations, other means for fluidly separating the main pump line 35 and the main suction line 30 may be used.

The main pump line 35 and main suction line 30 are not in fluid communication with each other, meaning water does not communicate between the two lines at the manifold 20, but may be connected in terms of adjacent walls within the manifold body. A single piece of material may be molded or cast for the manifold 20 with the main pump line 35, main suction line 30 and the top portion 25. Alternatively, the manifold 20 may be manufactured in multiple pieces and connected through welding, glue or other means of securing the pieces together. The manifold cover 38 may engage the manifold body through frictional fit, snap fit, threads on the manifold and the manifold cover, screws or other means to secure the cover to the body.

The cover 38 may be generally shaped as a torus, with a central opening 47 that may fit around the central opening 42 of the top portion 25 of the body 22 of the manifold 20. This may give the top portion 25, in conjunction with the cover 38, a general "donut"-shape. The central opening 42 of the top portion 25 and the central opening 45 of the cover 38 may allow the main pump line 35 to be fluidly connected to the base of a removable seat back 40 containing one or more jets. Additionally, the cover 38 may comprise a depression 55 that may allow for a more secure connection with the base of a removable seat back 40, as described in more detail below.

The main suction line 30 connects to the outer ring portion or suction head 44 of the top portion 25 of the manifold 20 and pulls the water to one or more pumps 12. The main suction line 30 may extend in a direction that is non-parallel to or even perpendicular to the main pump line 35. The main suction line 30 may extend in a downward direction or an angled downward direction from the manifold 20 when the manifold is in typical use orientation in a spa. The main suction line 30, the main pump line 35 and central opening 42 may all comprise directionally different axes or flows.

The manifold cover 38 may comprise a plurality of holes 53 that transverse the cover. The holes 53 may provide at least one level of filtration to prevent large particles from entering the pump(s) and may also serve to comply with safety requirements for pool and spa intakes. As stated above, the manifold cover 38 may include a central opening, or void 45, which gives the manifold a "donut"-like appearance at the top, and which may allow for engagement of a JetPak® removable seat back into the central opening of the manifold while leaving the manifold cover with its plurality of holes 53 exposed. The central opening 45 of the cover may be in communication with the central opening 42 of the manifold, which is in communication with the main pump line 35. The main pump line 35 may push water through the central opening 42 of the manifold, central opening 45 of the cover, and through to the base of a JetPak® removable seat back. Arrow 57 in FIG. 8 indicates the direction of water movement through the main pump line 35 and the central opening 45 of the cover 38 (removable seat back not shown). Arrows 59 in FIG. 8 indicate the opposite direction of water movement through the plurality of exposed holes 53 in the manifold cover, and into the main suction line 30.

Figure 9:
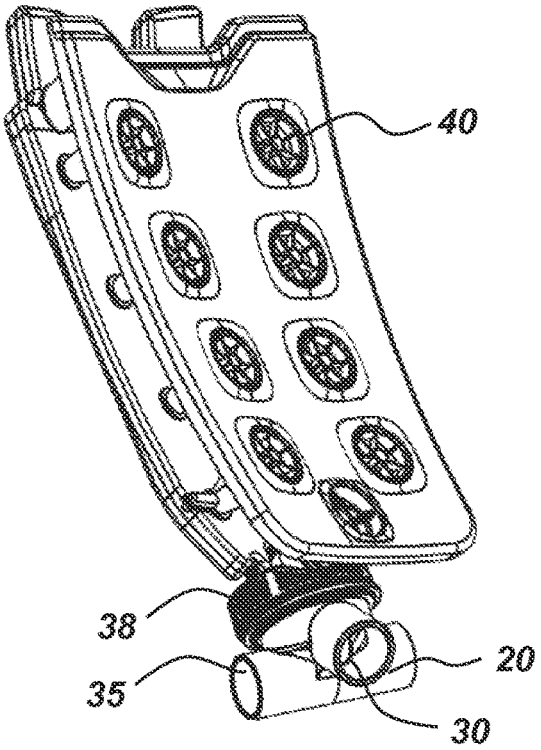
FIG. 9 is a front, perspective view of the manifold of FIG. 5 attached to a JetPak® removable seat back.
Figure 10:
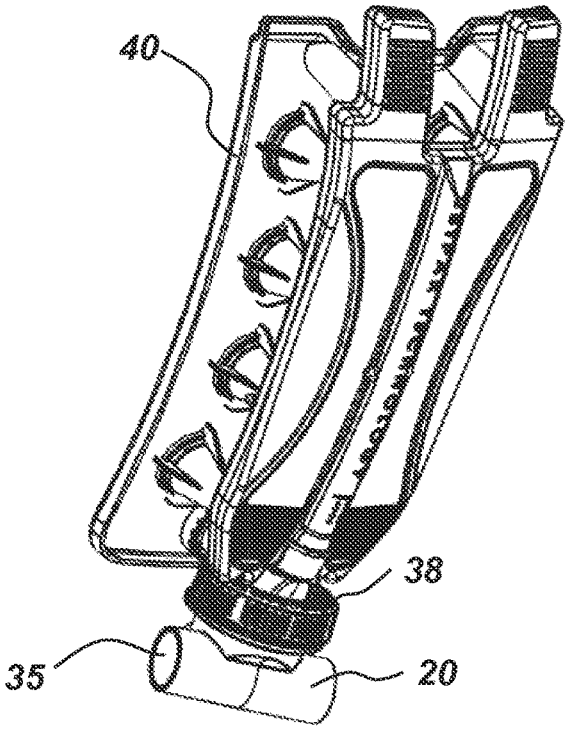
FIG. 10 is a rear, perspective view of the manifold and JetPak® removable seat back of FIG. 9.
Figure 11:
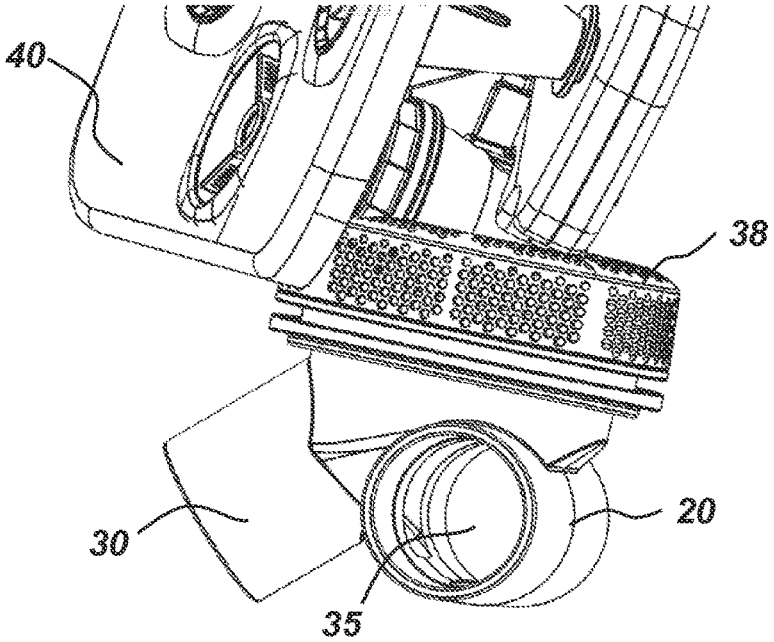
FIG. 11 is a detailed partial view of the manifold and JetPak® removable seat back of FIG. 9.

Turning now to FIGS. 9-11, the manifold 20 may be attached directly to the base of a JetPak® removable seat back 40, such that the main pump line 35 is in fluid communication with the removable seat back 40 and is able to pump water into the jets of the removable seat back and out into the main body of the spa shell. The base of the removable seat back 40 may be circular and may be sized to fit within or otherwise engage the central opening 45 of the cover 38 and be in direct fluid contact with the central opening 42 of the manifold 20 (and thus in fluid contact with the main pump line 35). This connection still allows the cover 38 with its plurality of holes for intake to be exposed. In some configurations, the cover 38 may be shaped with a recess or depression 55 towards one side, with the removable seat back 40 having a complementary-shaped projection that may rest on or otherwise engage the depression 55. The removable seat back 40 may thus be connected to the main pump line 35, while still allowing water to flow through the plurality of holes in the cover 38, into the suction head 44 and then into the main suction line 30.

Figure 12:
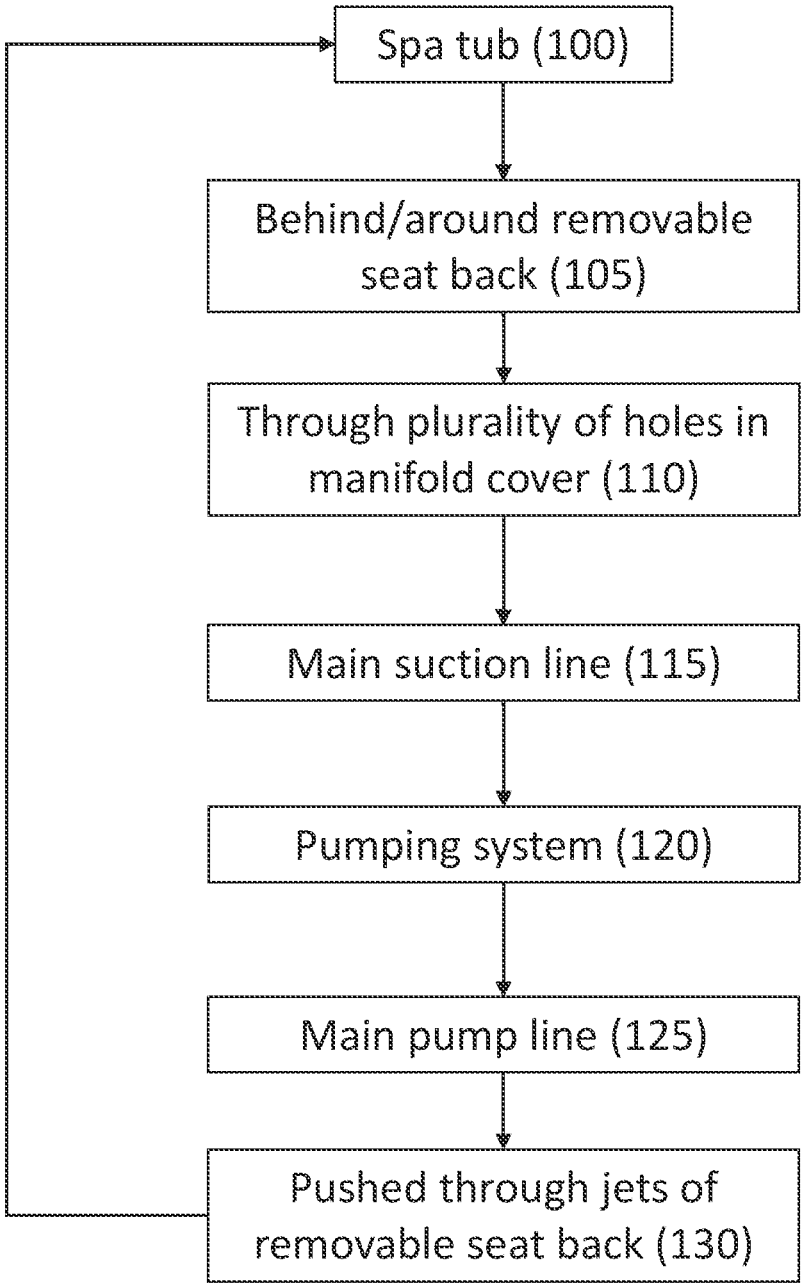
FIG. 12 is a diagram of the water flow according to one configuration.

In configurations with one or more manifolds placed behind a removable seat back 40, flow of water through the system may be safer compared to manifolds present in the main portion of the spa tub where users typically bathe. As used herein, the "main portion" of the spa means the portion that users come into direct contact with as they typically bathe in the spa. One configuration for the water flow is described in the diagram of FIG. 12. Although the diagram depicts a "starting point" for the water and an "ending point" it will be appreciated that the system is fluid and circular and may have no beginning or ending. Water may begin in the main portion of the spa tub (100), then flow behind, under, or otherwise around a removable seat back 40 (105). Once behind the removable seat back, the water may be taken in through the plurality of holes in the cover of the manifold (110), through the outer ring portion 44 of the manifold and to the main suction line (115). The water then enters the pumping system (120), including one or more pumps 12 (see FIGS. 1-2). Pumps 12 drive the water into the main pump line (125), through the central opening 42 in the manifold and manifold cover, and through the jets of the removable seat back (130) where it then has returned to the spa tub (100). As seen in FIGS. 1-2, multiple manifolds may be connected together in series or non-series and driven by a single pumping system that may include one or more pumps 12.

Also contemplated is a method for pumping water through a spa system. The method may comprise the step of placing an intake, such as a manifold 20 or other intake, behind a removable seat back of the spa. In other configurations, the manifold 20 or intake may be placed behind another removable structure such that the intake is in fluid communication with the main spa bathing area. For example, a portion of a sidewall of the spa may be removable and an intake or manifold may be placed behind it. In some configurations, the intake or manifold 20 may be placed behind a removable seat back and proximal to the bottom of the removable seat back. One or more manifolds or intakes may be used. The method may also comprise a pump system containing one or more pumps 12 driving or pumping water through a main pump line of the manifold, through one or more jets in a removable seat back, and out into the main spa tub. This driving force by the pump of water out into main spa tub may also cause water to be taken into the manifold or other intake through the main suction line, and into the pump system.

Although the foregoing disclosure provides many specifics, such as use of the system in spas, it will be appreciated that pools, and other water holding devices to be covered are contemplated and these should not be construed as limiting the scope of any of the ensuing claims. Similarly, although the disclosure is generally described as being used with one or more JetPak® removable seat backs, it will be appreciated that other types of removable seat backs, removable jets, or removable portions of seating or other parts of the spa are contemplated and these should not be construed as limiting the scope of any of the ensuing claims. Other embodiments and configurations may be devised which do not depart from the scopes of the claims. Features from different embodiments and configurations may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A system for pumping water through a spa, the system comprising:

a manifold comprising a body and a cover, the body having a top portion, a main suction line in fluid communication with the top portion and a main pump line in fluid communication with the top portion, the top portion further comprising a wall fluidly separating the main suction line from the main pump line, the cover of the manifold comprising a plurality of holes, and wherein the manifold is located behind a removable seat back of the spa.

2. The system of claim 1, wherein the wall of the top portion comprises a cylindrical wall proximal to a center of the top portion of the manifold, forming a central opening in fluid communication with the main pump line and an outer ring portion in fluid communication with the main suction line.

3. The system of claim 2, wherein the cover of the manifold comprises a cover central opening, the cover central opening positioned above the central opening of the top portion.

4. The system of claim 3, wherein the removable seat back comprises a base portion extending through the cover central opening of the cover of the manifold and in fluid communication with the main pump line.

5. The system of claim 1, wherein the system further comprises a pump for forcing water through the main pump line.

6. The system of claim 5, wherein the system further comprises at least one jet, the pump forcing water through the main pump line, through the jet, and into a spa tub.

7. The system of claim 1, wherein the system further comprises a spa shell having at least one recess formed therein, and the removable seat back engageable within the recess.

8. The system of claim 7, further comprising a non-watertight seal between the removeable seat back and the recess.

9. The system of claim 8, wherein the manifold is located at a base of the at least one recess.

10. The system of claim 1, wherein the system further comprises a spa shall with a plurality of recesses formed therein, and a plurality of removable seat backs engageable within the plurality of recesses.

11. The system of claim 10, wherein the plurality of recesses each comprise a base, and wherein system further comprises the manifold located at the base of the plurality of recesses.

12. A system for pumping water through a spa, the system comprising: a manifold comprising a body and a cover, the body having a main pump line and a main suction line, the main pump line located in a central opening of the body and the cover having a central cover opening in fluid connection with the central opening of the body;

the main suction line fluidly separated from the main pump line within the manifold; and the cover of the manifold comprising a plurality of holes therethrough, the plurality of holes in fluid connection with the main suction line.

13. The system of claim 12, wherein the manifold is separated from a main portion of a spa tub by one or more removable structures.

14. The system of claim 13, wherein the manifold is separated from the main portion of the spa tub by at least one removable seat back.

15. The system of claim 12, wherein the main suction line circumferentially surrounds the main pump line.

16. A method of pumping water through a spa, the method comprising:

positioning a manifold behind a removable seat back of the spa, the manifold having an intake in fluid connection with a main suction line and the manifold having a main pump line fluidly separated from the main suction line at the manifold, the manifold comprising:

a body and a cover, the body having a main pump line and a main suction line, the main pump line located in a central opening of the body and the cover having a central cover opening in fluid connection with the central opening of the body, the main suction line fluidly separated from the main pump line within the manifold, and the cover of the manifold comprising a plurality of holes therethrough, the plurality of holes in fluid connection with the main suction line.

17. A method of pumping water through a spa, the method comprising:

positioning a manifold behind a removable seat back of the spa, the manifold having an intake in fluid connection with a main suction line and the manifold having a main pump line at least partially fluidly separated from the main suction line at the manifold, the manifold comprising:

a body and a cover, the body having a top portion, a main suction line in fluid communication with the top portion and a main pump line in fluid communication with the top portion, the top portion further comprising a wall fluidly separating the main suction line from the main pump line, the cover of the manifold comprising a plurality of holes, and wherein the manifold is located behind a removable seat back of the spa.

* * * * *